US006572518B1

(12) United States Patent
Midorikawa et al.

(10) Patent No.: US 6,572,518 B1
(45) Date of Patent: Jun. 3, 2003

(54) CERMET POWDER FOR SPRAYED COATING EXCELLENT IN BUILD-UP RESISTANCE AND ROLL HAVING SPRAYED COATING THEREON

(75) Inventors: Satoru Midorikawa, Chiba (JP); Shoichi Katoh, Saitama Pref. (JP)

(73) Assignees: Kawasaki Steel Corporation (JP); Praxair S. T. Technology, Inc. (JP)

( * ) Notice: Subject to any disclaimer, the term of this patent is extended or adjusted under 35 U.S.C. 154(b) by 0 days.

(21) Appl. No.: 09/869,780

(22) PCT Filed: Nov. 8, 2000

(86) PCT No.: PCT/JP00/07837

§ 371 (c)(1),
(2), (4) Date: Jul. 27, 2001

(87) PCT Pub. No.: WO01/34866

PCT Pub. Date: May 17, 2001

(30) Foreign Application Priority Data

Nov. 9, 1999 (JP) ..... 11-318359

(51) Int. Cl.[7] ..... B25F 5/02; B21D 53/00
(52) U.S. Cl. ..... 492/58; 492/54; 29/895.32
(58) Field of Search ..... 492/58, 1, 3, 48, 492/54, 53; 29/895.32, 895.3, 895.33; 428/627, 628, 629, 640; 427/446, 451, 456, 453

(56) References Cited

U.S. PATENT DOCUMENTS 4,124,737 A * 11/1978 Wolfla et al. ..... 428/640
5,060,714 A * 10/1991 Yamauchi et al. ..... 164/428
5,070,587 A * 12/1991 Nakahira et al. ..... 492/53
5,078,837 A * 1/1992 Descamp et al. ..... 205/181
5,161,306 A * 11/1992 Nakahira et al. ..... 29/895.32
5,328,763 A * 7/1994 Terry ..... 428/559
5,652,028 A * 7/1997 Taylor et al. ..... 427/451
5,700,423 A * 12/1997 Gao ..... 428/469
5,763,107 A * 6/1998 Rickerby et al. ..... 428/628
6,129,994 A * 10/2000 Harada et al. ..... 428/627
6,238,807 B1 * 5/2001 Yasuda et al. ..... 428/627

FOREIGN PATENT DOCUMENTS

EP 440437 A2 * 7/1991
EP 0 440 437 A2 * 7/1991
JP 408176782 A * 7/1996
JP 409020975 A * 1/1997

* cited by examiner

*Primary Examiner*—Gregory Vidovich
*Assistant Examiner*—Marc Jimenez
(74) *Attorney, Agent, or Firm*—Piper Rudnick LLP

(57) ABSTRACT

A cermet powder for thermal spray coating, which is sprayed on a roll surface of a conveyer roll inside a furnace for heat treating a high tensile strength steel strip thereby to form a coating film, comprises: an alloy powder containing 3 to 8 mass % of Al, 16 to 25 mass % of Cr, 0.1 to 1 mass % of Y, and at least one of Co and Ni as the residual, with respect to the whole amount of the cermet powder; and a ceramic powder containing at least one of 1 to 5 mass % of a boride and 5 to 10 mass % of a carbide, with respect to the whole amount of the cermet powder.

13 Claims, 1 Drawing Sheet

CERMET POWDER FOR SPRAYED COATING EXCELLENT IN BUILD-UP RESISTANCE AND ROLL HAVING SPRAYED COATING THEREON

TECHNICAL FIELD

The invention relates to cermet powder for thermal spray coating, which is applied to an inside-furnace roll for conveying a heat-treated material in a heat treating furnace such as a continuous annealing furnace for steel strips and has excellent build-up resistance property and excellent oxidization resistance property. The invention also relates to a spray coated roll on whose surface the cermet powder for thermal spray coating has been sprayed and which is provided inside a furnace (which roll will be referred to as an "inside-furnace roll" or a "spray coated roll" hereinafter).

BACKGROUND ART

When a steel strip is continuously annealed, the steel strip is conveyed in an oxidizing or reducing atmosphere at the temperature of 600 to 1300° C. A number of heat resistant rolls is provided in the face such that the rolls are used as inside-furnace rolls and the steel strip is supported by these rolls. However, after being continuously used for a long time, oxides of Mn, Si, Al etc. and the like which are oxides attached on the steel strip (or scale) etc. are deposited and accumulated on the surface of the inside-furnace rolls, whereby what is called "build-up" is formed. When such build-up is formed, the build-up may generate scars on the surface of the steel strip and thus cause deterioration of quality thereof. Accordingly, the operation must be stopped immediately and the surfaces of the inside-furnace rolls have to be cleaned in a dummy material or the like, or in a worse case, the furnace must be opened, so that grinding or the like of the surfaces of the inside-furnace rolls or exchange of the rolls can be carried out.

Due to this, in order to prevent the accumulation of build-up on the surface of inside-furnace rolls, an invention in which a thermal sprayed coating is formed on the roll surface has been proposed. Several types of such rolls have already been used in practice. However, none of them can completely prevent the build-up yet.

As shown in FIG. 1, rows of build-up 3 are formed in the circumferential direction of the roll, in parallel with each other, along the portion of the roll on which a metal strip 1 is conveyed.

The build-up 3 has a sectional configuration as shown in FIG. 2. FIG. 2 shows a state in which the build-up 3 has been formed on a roll surface of an inside-furnace roll 2, i.e., on a thermal sprayed coating 2*a* formed on a roll base material 2*b*.

The inventions relating to a thermal sprayed coating film which have been disclosed will be described hereinafter.

(1) Unexamined Publication No. JP-2-270955 A

A hearth roll for a high temperature heat treating furnace having a cermet thermal spray coating film formed thereon, the cermet thermal spray coating film being made of an alloy containing 5 to 20 wt. % of $Cr_2O_3$—$Al_2O_3$ and 95–80 wt. % of Co—Ni—Cr—Al—Y (2) Unexamined Publication No. JP-63-199857 A A high-temperature-resistant spray coated member having a cermet thermal spray coating provided thereon, the cermet thermal spray coating being composed of 51 to 95 vol. % of $Al_2O_3$ and MCrAlY (M is an alloy made from the compounds selected from the group consisting of Fe, Ni, Co and Si)

(3) Unexamined Publication No. JP-63-47379 A

An inside-furnace roll for a heat processing furnace, in which the surface layer of a cermet thermal spray coating layer composed of 30 to 80 wt. % of $ZrSiO_4$ and MCrAlY (M is an alloy made from the compounds selected from the group consisting of Fe, Ni, Co and Ta) is coated with chromium oxide (4) Unexamined Publication No. JP-60-56058 A A hearth roll having a spray coated layer of $Al_2O_3$—MgO as the roll uppermost layer, in addition to at least two intermediate layers provided between the uppermost layer and the roll parent material and formed by spraying of a mixture of $Al_2O_3$—MgO and a bonding metal (5) Unexamined Publication No. JP-3-226552 A A thermal spray coating material composed of 5 to 50 vol. % of boride and MCrAlY (M is Fe or Ni or Co) and a coated article having a thermal spray coating film made of the thermal spray material (6) Unexamined Publication No. JP-8-67960 A A cermet thermal spray material produced by mixing at least one type of powdery, refractories, which exhibits low reactivity against manganese oxide, is selected from the group consisting of $MgAl_2O_4$, $Y_2O_3$ and MgO, and of which compound content is in the range of 5 to 90 wt. %, with MCrAlY (M is Fe or Ni or Co), and a hearth roll using the same (7) Unexamined Publication No. JP-7-11420 A A cermet film and a roll for a heat treating furnace which contain: 1 to 60vol. % of at least one type boride selected from the group consisting of $CrB_2$, $ZrB_2$, WB, $TiB_2$ and the like; 5 to 50 vol. % of at least one type of carbide selected from the group consisting of $Cr_3C_2$, TaC, WC, ZrC, TiC, NbC and the like; and metal (for example, MCrAlY) which substantially constitutes the residual.

Here; MCrAlY generally represents a heat resisting alloy in which Cr, Al and Y are added, each by an appropriate amount, to a base material which is at least one type of compound selected from the group consisting of F, Ni and Co.

The inventions of the aforementioned (1)–(7) exhibit not a little build-up reducing effect, in the heat treating of an ordinary, common steel strip. If the heat treating includes treating of high tensile strength steel material (the steel material which normally exhibits tensile strength of no lower than 340 MPa in the state of a cold rolled steel plate and tensile strength of no lower than 440 MPa in the state of a hot rolled steel plate) to some extent, such treating of high tensile strength steel material generally does not cause a problem, as long as the amount of the high tensile strength steel material to be processed is small.

However, in recent years, as the use of high tensile strength steel material increases, the measurement as described above can no longer be so effective for prevention of build-up.

Specifically, the high tensile strength steel material contains a larger amount of Mn (0.6 to 3.5 mass %), Si (no more than 2 mass %) and the like than ordinary steel materials do and these elements tend to appear, in a condensed state, on the surface of the steel material during the heat treating process, whereby a relatively large amount of Mn oxides are formed on the surface of the steel strip. Due to this, when a relatively large amount of high tensile strength steel material is heat treated, the build-up resistance property which is more excellent than the conventional level is required of the inside-furnace roll.

DISCLOSURE OF THE INVENTION

The present invention has an object to provide long-durability cermet powder for thermal spray coating, which has excellent build-up resistance property, has excellent oxidization resistance property required of an inside-furnace roll and thus solves the aforementioned problems, and to provide a thermal spray coated roll inside-furnace roll in which the aforementioned cermet powder is applied.

In short, the present invention has solved the aforementioned problem by the cermet powder for thermal spray coating or the thermal spray coated roll as described below.

(1) A cermet powder for thermal spray coating, which is used for a conveyer roll inside a heat treating furnace for a steel strip, comprising:

an alloy powder containing 3 to 8 mass % of Al, 16 to 25 mass % of Cr, 0.1 to 1 mass % of Y, and at least one of Co and Ni as the residual, with respect to the whole amount of the cermet powder; and a ceramic powder containing at least one of 1 to 5 mass % of a boride and 5 to 10 mass % of a carbide, with respect to the whole amount of the cermet powder.

(2) A cermet, powder for thermal spray coating described in the aforementioned (1), wherein the cermet powder contains ceramic powder of at least one type of rare earth oxide selected from the group consisting of $Y_2O_3$, $La_2O_3$ and $CeO_2$, by the total amounts of the compounds of no less than 10 mass % with respect to the whole amount of the cermet powder.

(3) A cermet powder for thermal spray coating described in the aforementioned (1) or (2), wherein the cermet powder contains 1 to 25 mass % of the ceramic powder, with respect to the whole amount of the cermet powder.

(4) A cermet powder for thermal spray coating described in the aforementioned (1), wherein the boride contains at least one compound selected from the group consisting of $ZrB_2$, CrB, TiB, MoB, by the total content of the boride of 1 to 5 mass %.

(5) A cermet powder for thermal spray coating described in the aforementioned (1), wherein the carbide contains at least one compound selected from the group consisting of $Cr_3C_2$, TiC, NbC, TaC, by the total content of the carbide of 5 to 10 mass %.

(6) A thermal spray coated roll, characterized in that it has a thermal sprayed coating formed on a roll surface thereof, the coating being formed by thermal spraying the cermet powder for thermal spray coating of any of the aforementioned (1) to (3) on the roll surface.

(7) A thermal spray coated roll of the aforementioned (6), wherein the thermal spray coated roll is a conveyer roll inside a heat treating furnace in which furnace a high tensile strength steel plate is conveyed.

BEST MODE FOR CARRYING OUT THE INVENTION

Figure 1:
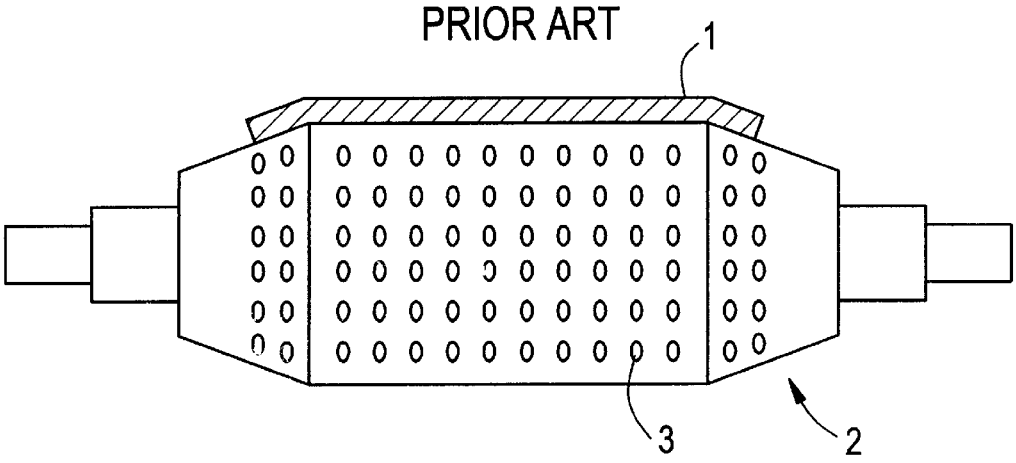
FIG. 1 PRIOR ART
FIG. 1 is a front view of an inside-furnace roll in which build-up has been generated.
Figure 2:
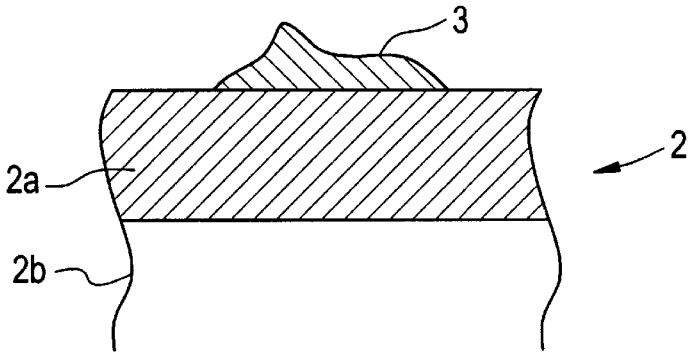
FIG. 2 PRIOR ART
FIG. 2 is a partial sectional view of an inside-furnace roll in which build-up has been generated on the surface thereof.

The inventors of the present invention have studied measures for obtaining sufficient build-up resistance property in the heat treating of high tensile strength steel material. As a result, they have discovered that reducing the content of Al in the alloy composition to 3 to 8 mass % with respect to the whole amount of the cermet powder (that is, making the content of Al lower than that of the conventionally used McrAlY) is effective for achieving the object.

Conventionally, it has been considered that 10 mass % or so of the Al content is effective for improving the build-up resistance and the oxidization resistance properties, because Al forms a protective film (aluminum oxide film) on the surface of the steel material. However, the recent studies have discovered that, when a steel containing Mn is heat treated, Mn or manganese oxide in the vicinity of the steel strip surface tends to react with the aluminum oxide film, whereby the build-up is rather facilitated. Specifically, when the high tensile strength steel material is heat treated (i.e., when the steel strip of such steel is conveyed in a furnace), the reaction:

$$MnO+Al_2O_3 \rightarrow MnAl_2O_4$$

is likely to occur on the roll surface.

Accordingly, when the content of Al in the cermet powder exceeds 8 mass %, the aluminum oxide film on the roll surface tends to be excessive, thereby to adversely affect the prevention of build-up, which is substantially constituted of manganese oxide and the like. On the other hand, when the content of Al is lower than 3 mass %, the protective film is not formed in a sufficient manner and exhibits particularly poor oxidization resistance property, thereby to cause the thermal sprayed coating to peel off at an early stage due to the oxidization of Co and/or Ni as the main components of the heat resistant alloy. Therefore, in the present invention, the content of Al in the heat resistant alloy is restricted to the range of 3 to 8 mass %. The content of Al in the heat resistant alloy is more preferably in the range of 4 to 7 mass %.

Next, the inventors have studied the appropriate amount of the ceramic powder to be blended, when a relatively small amount of Al is added as described above. Here, the inventors faced a problem that the oxidization resistance property cannot be ensured when a relatively large amount (generally 25 mass % or more) of the ceramic powder is added as in the prior art, while the occurrence of build-up cannot be prevented in a sufficient manner under a condition which simulates the heat treating of the high tensile strength steel material, when the content of the ceramic powder is relatively small.

The inventors have assiduously made research in the solution of the aforementioned problem. Then, they have discovered that, by adding a relatively small amount of boride and/or carbide, and optionally by further adding at least one type of compound selected from the group consisting of $Y_2O_3$, $La_2O_3$ and $CeO_3$, the build-up resistance property can be obtained in a sufficient manner when the high tensile strength steel material is heat processed, although the content of the ceramic is 1 to 25 mass %.

Each component contained in the ceramic powder will be described hereinafter.

The boride and the carbide both exhibit, when each is added by a small amount, an effect of reducing the amount of Al in the protective film, although details of the mechanism are not known yet. As a result, the boride and the carbide significantly improves the build-up resistance property. In order to obtain such an effect of improving the build-up resistance property, not less than 1 mass % of boride with respect to the whole amount of the cermet (note that all the contents of the components described hereinafter are expressed as the contents with respect to the whole amount of the cermet, unless stated otherwise) or not less than 5 mass % of carbide must be added.

When the content of the boride which has been added exceeds 5 mass %, the thermal sprayed coating film becomes brittle. When the content of the carbide which has been added exceeds 10 mass %, the expansion rate of volume of the thermal sprayed coating during the transformation at a high temperature becomes large, whereby the thermal sprayed coating film is made weak. At each case, the possibility that separation of the thermal sprayed coating film occurs is increased. Accordingly, in the present invention, the content of the boride is set in the range of 1 to 5 mass % and the content of the carbide is set in the range of 5 to 10 mass %.

Examples of the boride include $ZrB_2$, CrB, TiB, MoStrip the like. In the present invention, at least one type of compound selected from the aforementioned group is contained in the ceramic powder such that the sum of the content(s) of the compound(s) selected from the aforementioned group is in the range of 1 to 5 mass %. Similarly, regarding the carbide, at least one type of compound selected from the group consisting of $Cr_3C_2$, TiC, NbC, TaC and the like is contained in the ceramic powder such that the sum of the content(s) of the compound(s) selected from the aforementioned group is in the range of 5 to 10 mass %.

In addition to the aforementioned components, by adding at least one type of rare metal oxide compound which are especially selected from the group consisting of $Y_2O_3$, $La_2O_3$ and $CeO_2$ such that the sum of the content(s) of the compound(s) is not smaller than 10 mass %, the build-up resistance property can be further improved. It is assumed that such an improvement is achieved because the aforementioned rare earth oxides each exhibit a large absolute value of standard free energy of oxide formation, thereby to form stable oxides and effect further reduction of $Al_2O_8$ in the protective film.

When the content of the ceramic powder (specifically, the total of the contents of the components thereof) which has been added exceeds 25 mass %, the oxidization resistance property of the thermal sprayed coating film deteriorates and separation of the thermal sprayed coating is more likely occur, as described above. On the other hand, when the aforementioned content of the ceramic powder which has been added is less than 1 mass %, the effect of improving the build-up resistance property will no longer be observed. Therefore, the total content of the ceramic powder is set in the range of 1 to 25 mass % with respect to the whole amount of the cermet powder.

Next, the composition of the heat resistant alloy powder other than the aforementioned Al will be described hereafter.

Cr improves the oxidization resistance property. However, as Cr is a metal which could adversely affect the build-up property if it is added too much, the content of Cr added is set within the range of 16 to 25 mass %. When the content of Cr is less than 16 mass %, the effect of improving the oxidization resistance property achieved by the metal is not sufficient. On the other hand, when the content of Cr exceeds 25 mass %, the build-up resistance property of the thermal sprayed coating deteriorates and the thermal sprayed coating film becomes brittle, whereby the coating is more likely to peel off.

Y is added because it improves the bonding property of the heat resistant alloy with the ceramic and serves to harden the protective film. However, when the content of Y which has been added exceeds 1 mass %, the element rather causes deterioration of the separation strength of the thermal sprayed film. Accordingly, in the present invention, the content of Y to be added is set at no more than 1 mass %. The content of Y is preferably not less than 0.1 mass %, and more preferably in the range of 0.5–1 mass %.

Co or Ni or an alloy thereof is used as the residual portion of the heat resistant alloy, in order to ensure the sufficient heat resistance property and the sufficient oxidization resistance property. In terms of achieving better adhesion property of the thermal sprayed coating, use of Co or a Co—Ni alloy in which the Co content exceeds the Ni content, which is easily dispersed from the thermal spray coating film side toward the parent material side, is slightly advantageous. The preferable Co/Ni ratio is no smaller than 1.1.

The details of the main components of the cermet powder are as described above. Impurities mixed into the alloy and/or the ceramic will not affect the aforementioned effects, as long as the amounts of the impurities are small. Examples of such possible impurities include Fe, Si, $SiO_2$, CaO, MgO and the like.

The aforementioned cermet is preferably brought into a powdery form (particles of generally 10 to 100 $\mu$m in diameter) by mixing the alloy powder and the ceramic powder according to the mixing method. When the particle diameter exceeds 100 $\mu$m, the powder does not melt so easily. On the other hand, when the particle diameter is less than 10 $\mu$m, the spray nozzle is likely to be clogged.

By spraying the aforementioned cermet on a roll made of a heat resistant cast steel or the like and forming a film thereon, a roll for heat treating, which exhibits the excellent build-up property and the sufficient oxidization property when a high tensile strength steel material is heat treated, can be obtained. Here, if the thickness of the thermal sprayed coating film is less than 30 $\mu$m, a sufficient product life may not be obtained. On the other hand, if the thickness of the thermal sprayed coating film is thicker than 150 $\mu$m separation of the thermal sprayed coating due to heat fatigue is likely to occur. Accordingly, the average thickness of the thermal sprayed film is preferably in the range of 30 to 150 $\mu$m.

Preferable examples of a method of thermal spraying the cermet on the roll include: the Explosive Spray Process (the name of the commercially available device is "Detonation Gun", which will be referred to as "D-GUN" hereinafter); the High Velocity Oxygen Fuel Flame Spray Process (which will be referred to as "HVOF" hereinafter, the names of the commercially available devices thereof are, for example, "JET-KOTE", "D-JET" and "JP-5000"). Any of the aforementioned methods may be employed.

EXAMPLES

The following examples were carried out in order to demonstrate the effect of the cermet powder of the present invention.

Figure 3:
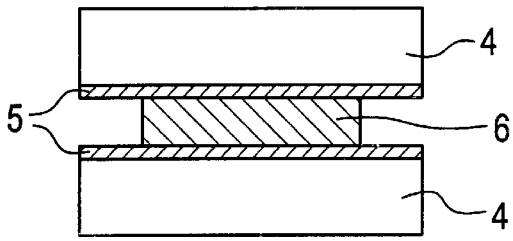
FIG. 3 is a sectional view of a test piece for the reaction tests of the present invention.

The configuration of the test piece used in the examples is shown in FIG. 3. In the preparation of each test piece, a SUS 304 base material 4 (width: 25 mm×depth: 25 mm×height: 10 mm) was prepared and each of the various types of cermet powder was thermal sprayed on the SUS base material according to the D-GUN method, whereby a thermal sprayed coating film 5 of 100 $\mu$m thickness was formed. The surface of the thermal sprayed coating film 5 was then finished by grinding.

Thereafter, as shown in FIG. 3, a high tensile strength steel plate 6 (C: 0.072 mass %, Si: 0.036 mass %, Mn: 1.7 mass %, S: 0.0035 mass %, P: 0.0076 mass %, Al: 0.033 mass %) was interposed by two surfaces, each being the surface on the side of the thermal sprayed coating film 5, of the two pieces of the SUS base material 4, whereby each test piece was produced.

Each of the test pieces thus prepared was subjected to the reaction test by putting the test piece in the experiment furnace having 3%$H_2$-97%$N_2$ annealing atmosphere at 900° C. for 60 hours.

After the reaction test in the experiment furnace, the test piece was taken out of the furnace, the high tensile strength steel plate thereof was removed, the sprayed surface determination of Mn was carried out by an EDX (energy dispersion-type X-ray analyzer), and the section of the sprayed surface was photographed by a SEM (scanning electron microscope).

In addition, at the same time, another set of test pieces were prepared by preparing a SUS base material (width: 50 mm×depth: 50 mm×height: 10 mm) for each test piece, forming a thermal sprayed coating film of average 100 μm thickness on each SUS base material according to the D-GUN method, and grinding the surface of the thermal sprayed coating film as finishing. Each test piece was subjected to the separation-by-heating test in which the test pieces were heated to 1000° C. in the experiment furnace, remained in the furnace at the temperature for 30 seconds, then taken out of the furnace and cooled in water.

Table shows the components of each thermal spray powder material (cermet powder) of test pieces No. 1–21, as well as the results of the examples.

The MnO reaction build-up shown in Table 1 is the result obtained by the surface determination of Mn by EDX. The MnO reaction build-up is evaluated as "significant" (when the build-up is not less than 30 mass %), "medium" (when the build-up is in the range of 15 mass % or more to less than 30 mass %), "slight" (when the build-up is in the range of 8 mass % or more to less than 15 mass %), "very slight" (when the build-up is in the range of 4 mass % or more to less than 8 mass %), and "extremely slight" (when the build-up is less than 4 mass %). The oxidization scale is evaluated as "large", "medium" or "small" on the basis of the observation of the SEM photographs of the section. "Large" indicates that the average thickness of scale is no less than 30 μm, "medium" indicates that the average thickness of scale is in the range of 5 μm or more to less than 30 μm, and "small" indicates that the average thickness of scale is less than 5 μm. The number of heating-cooling cycle required for separation is the result of the aforementioned separation-by-heating test, in which a heating-cooling process is counted as one (cycle) and the number of the cycles required before reaching the separation of the coating was counted.

From the results shown in Table 1, it is confirmed that the present examples exhibit no or extremely slight MnO build-up, the relatively small oxidization scale, and the relatively large number (30 or more) of heating-cooling cycle required for separation. From the results shown in Table 1, it is also confirmed that the coating film having most excellent build-up resistance, oxidization resistance and durability properties was formed in the present examples. In order to suppress the build-up at the "extremely slight" level, setting the Al content at not more than 7 mass % is effective. Further, by adding an appropriate amount of rare earth oxides such as $Y_2O_3$, occurrence of the build-up can be completely prevented. The criteria of the total evaluation are as follows: "◎" (the number of heating-cooling cycle required for separation is 30 or more, no MnO build-up and "small" oxidization scale); "○" (MnO build-up is "very slight"); and "X" (the number of heating-cooling cycle required for separation is less than 30).

In the present examples, the D-GUN method is employed as the method of thermal spraying the cermet powder on a test piece. However, the present invention is not limited to this particular thermal spraying method, and JP-5000, D-JET, JET-KOTE and the like of the names of the commercially available devices of HVOF may also be employed.

Next, the examples of the thermal spray powder material which were substantially the same as those of Table 1 except that the carbides were added in place of the borides are shown in Table 2. The method of the experiment and the method of evaluating the results were the same as that employed in the examples of Table 1.

From the results shown in Table 2, it is confirmed that the present examples exhibit no or extremely slight MnO build-up, the relatively small oxidization scale, and the relatively large number (30 or more) of heating-cooling cycle required for separation. From the results shown in Table 2, it is also confirmed that the coating film having most excellent build-up resistance, oxidization resistance and durability properties was formed in the present examples.

In the aforementioned description, the CoCrAlY-based heat resistant alloy powder is raised as the example of the heat resistant alloy powder. However, the present invention is not limited to this example, and the NiCrAlY-based, or the CoNiCrAlY-based, or the NiCoCrAlY-based heat resistant alloy powder may be employed.

Further, although $Y_2O_3$ is raised as an example of the rare earth oxide in the aforementioned description, the rare earth oxide is not limited to $Y_2O_3$ but may be $La_2O_3$ or $CeO_2$. It has been confirmed that $La_2O_3$ or $CeO_2$ achieves substantially the same effect as $Y_2O_3$.

With respect to some of the present examples which preferably realize the present invention, the components of the spray powder material and the test results thereof are shown in Table 3. The method of conducting the experiments and the method of evaluating the results were similar to those employed in the experiments of Table 1.

All of the present examples shown in Table 3 exhibit no or extremely slight MnO build-up, a relatively small oxidization scale, and a relatively large number (30 more) of heating-cooling cycle required for separation.

Next, the cermet powder for thermal spray coating of the present invention (the cermet powder of No. 37 of Table 2: Specifically, the cermet powder for thermal spray coating produced by mixing a heat resistant alloy powder material, in which the Al content was 6 mass %, the Cr content was 20 mass %, the Y content was 0.8 mass % and the residual was Co, with 5 mass % of $Cr_3C_2$ as a carbide and 13 mass % of $Y_2O_3$ as a rare earth oxide) was sprayed, by using the D-Gun method, on the roll surface of a roll (800 mm in diameter, 2200 mm in length) inside a furnace of a continuous annealing line, whereby an inside-furnace roll of the present invention was experimentally produced. The obtained roll was actually installed in a furnace and used for the heat processing of a steel plate, for evaluation. The average thickness of the thermal sprayed coating film was set at 100 μm.

A conventional inside-furnace roll was prepared, for comparison, by spraying on a roll the conventional cermet powder for thermal spray coating which contained MCrAlY (M was Fe or Ni or Co) and $Al_2O_3$ by using the D-GUN method similar to that employed in the present examples.

The inside-furnace roll of the present invention and the conventional inside-furnace roll were applied to a continuous annealing line in which the maximum line speed: 500 m/min, the highest temperature in the furnace: 950° C., and the atmosphere inside the furnace: the $H_2$—$N_2$ atmosphere. The continuous annealing line described above was what is called "sheet CAL" which carried out the processing of the high tensile strength steel at the processing rate of 100,000 km/month.

As a result, in the conventional inside-furnace roll, the generation of build-up resulted from MnO was observed after three months, and slight separation of the coating film which had presumably resulted from the oxidization of the coating film occurred after eighteen months. On the contrary, in the inside-furnace roll of the present invention, no generation of build-up resulted from MnO was observed after twenty-four months, and slight separation of the coating film which had presumably resulted from the oxidization of the coating film as observed in the conventional roll was not observed, either.

TABLE 1

| | mass % | | | | | | | | | Number of heating-cooling cycle | | |
|---|---|---|---|---|---|---|---|---|---|---|---|---|
| No. | Co | Cr | Al | Y | $ZrB_2$ | $Y_2O_3$ | Ceramic total | MnO build-up | Oxidation scale | required for separation | Evaluation | |
| 1 | Residual | 25 | 12 | 0.8 | 3 | — | 3 | Medium | Small | >30 | x | Comparative Example |
| 2 | Residual | 25 | 9 | 0.8 | 3 | — | 3 | medium | Small | >30 | x | Comparative Example |
| 3 | Residual | 25 | 8 | 0.8 | 3 | — | 3 | very slight | Small | >30 | ○ | Present Example |
| 4 | Residual | 25 | 7 | 0.8 | 3 | — | 3 | extremely slight | Small | >30 | ○ | Present Example |
| 5 | Residual | 25 | 6 | 0.8 | 3 | — | 3 | extremely slight | Small | >30 | ○ | Present Example |
| 6 | Residual | 25 | 5 | 0.8 | 3 | — | 3 | extremely slight | Small | >30 | ○ | Present Example |
| 7 | Residual | 25 | 4 | 0.8 | 3 | — | 3 | extremely slight | generally small | >30 | ○ | Present Example |
| 8 | Residual | 25 | 3 | 0.8 | 3 | — | 3 | extremely slight | generally small | 30 | ○ | Present Example |
| 9 | Residual | 25 | 2 | 0.8 | 3 | — | 3 | very slight | large | 27 | x | Comparative Example |
| 10 | Residual | 26 | 6 | 0.8 | 3 | — | 3 | very slight | Small | 16 | x | Comparative Example |
| 11 | Residual | 24 | 6 | 0.8 | 3 | — | 3 | extremely slight | Small | >30 | ○ | Present Example |
| 12 | Residual | 17 | 6 | 0.8 | 3 | — | 3 | extremely slight | Small | >30 | ○ | Present Example |
| 13 | Residual | 16 | 6 | 0.8 | 3 | — | 3 | extremely slight | Small | >30 | ○ | Present Example |
| 14 | Residual | 15 | 6 | 0.8 | 3 | — | 3 | very slight | medium | 28 | x | Comparative Example |
| 15 | Residual | 25 | 6 | — | 3 | — | 3 | very slight | medium | 20 | x | Comparative Example |
| 16 | Residual | 25 | 6 | 0.2 | 3 | — | 3 | extremely slight | Small | >30 | ○ | Present Example |
| 17 | Residual | 25 | 8 | 0.5 | 3 | — | 3 | extremely slight | Small | >30 | ○ | Present Example |
| 18 | Residual | 25 | 8 | 1.8 | 3 | — | 3 | very slight | Small | 25 | x | Comparative Example |
| 19 | Residual | 25 | 8 | 0.8 | — | — | — | significant | large | >30 | x | Comparative Example |
| 20 | Residual | 25 | 8 | 0.8 | 0.3 | — | 0.3 | medium | Small | >30 | x | Comparative Example |
| 21 | Residual | 25 | 6 | 0.8 | 1 | — | 1 | extremely slight | Small | >30 | ○ | Present Example |
| 22 | Residual | 25 | 6 | 0.8 | 5 | — | 5 | extremely slight | Small | >30 | ○ | Present Example |
| 23 | Residual | 25 | 6 | 0.8 | 6 | — | 6 | extremely slight | Small | 15 | x | Comparative Example |
| 24 | Residual | 25 | 6 | 0.8 | 3 | 8 | 11 | very slight | Small | 30 | Δ | Comparative Example* |
| 25 | Residual | 25 | 8 | 0.8 | 3 | 10 | 13 | none | Small | >30 | ◎ | Present Example |
| 26 | Residual | 25 | 6 | 0.8 | 3 | 15 | 18 | none | Small | >30 | ◎ | Present Example |
| 27 | Residual | 25 | 6 | 0.8 | 3 | 24 | 27 | very slight | Small | 22 | x | Comparative Example |

*slightly poorer than the material (No. 6) having substantially the same composition except for the absence of rare earth oxides. Also poor in the cost performance

TABLE 2

| No. | Co | Cr | Al | Y | $Cr_2C_2$ | $Y_2O_3$ | Ceramic total | MnO build-up | Oxidation scale | Number of heating-cooling cycle required for separation | Evaluation | |
|---|---|---|---|---|---|---|---|---|---|---|---|---|
| | mass % | | | | | | | | | | | |
| 28 | Residual | 20 | 6 | 0.8 | — | — | — | large | large | >30 | x | Comparative Example |
| 29 | Residual | 20 | 6 | 0.8 | 3 | — | 3 | medium | Medium | >30 | x | Comparative Example |
| 30 | Residual | 20 | 6 | 0.8 | 5 | — | 5 | extremely slight | Small | >30 | ○ | Present Example |
| 31 | Residual | 20 | 6 | 0.8 | 7 | — | 7 | extremely slight | Small | >30 | ○ | Present Example |
| 32 | Residual | 20 | 6 | 0.8 | 10 | — | 10 | extremely slight | Small | >30 | ○ | Present Example |
| 33 | Residual | 20 | 6 | 0.8 | 12 | — | 12 | very slight | Small | 12 | x | Comparative Example |
| 34 | Residual | 20 | 6 | 0.8 | 7 | 10 | 17 | none | Small | >30 | ⊙ | Present Example |
| 35 | Residual | 20 | 6 | 0.8 | 7 | 12 | 19 | none | Small | >30 | ⊙ | Present Example |
| 36 | Residual | 20 | 6 | 0.8 | 7 | 20 | 27 | very slight | small | 15 | x | Comparative Example |
| 37 | Residual | 20 | 6 | 0.8 | 5 | 13 | 18 | none | Small | >30 | ⊙ | Present Example |
| 38 | residual | 20 | 6 | 0.8 | 10 | 18 | 28 | very slight | Small | 14 | x | Comparative Example |

TABLE 3

| No. | Co | Ni | Cr | Al | Y | | Ceramic total | MnO build-up | Oxidation scale | Number of heating-cooling cycle required for separation | Evaluation | |
|---|---|---|---|---|---|---|---|---|---|---|---|---|
| | (mass %) | | | | | | | | | | | |
| 39 | — | residual | 22 | 6 | 0.9 | $Cr_3C_2$ 6 wt % | 6 | extremely slight | Small | >30 | ○ | Present Examples |
| 40 | residual | 20 | 18 | 5 | 0.6 | ZrB 2 wt % | 2 | extremely slight | Small | >30 | ○ | Present Examples |
| 41 | 20 | residual | 24 | 4 | 1.0 | ZrB 4 wt % | 4 | extremely slight | Small | >30 | ○ | Present Examples |
| 42 | Residual | — | 20 | 6 | 0.8 | $Cr_3C_2$ 8 wt %<br>ZrB 2 wt. % | 10 | extremely slight | Small | >30 | ○ | Present Examples |
| 43 | Residual | — | 20 | 6 | 0.8 | $Cr_3C_2$ 8 wt %<br>ZrB 1 wt %<br>$Y_2O_3$ 12 wt % | 21 | none | Small | >30 | ⊙ | Present Examples |
| 44 | Residual | — | 20 | 6 | 0.8 | CrB 5 wt % | 5 | Extremely slight | Small | >30 | ○ | Present Examples |
| 45 | Residual | — | 20 | 6 | 0.8 | TlB 3 wt % | 3 | Extremely slight | Small | >30 | ○ | Present Examples |
| 46 | Residual | — | 20 | 6 | 0.8 | TlC 8 wt % | 8 | Extremely slight | Small | >30 | ○ | Present Examples |
| 47 | Residual | — | 20 | 6 | 0.8 | NbC 7 wt % | 7 | Extremely slight | Small | >30 | ○ | Present Examples |
| 48 | Residual | — | 20 | 6 | 0.8 | ZrB 1 wt %<br>CrB 2 wt % | 3 | Extremely slight | Small | >30 | ○ | Present Examples |
| 49 | Residual | — | 20 | 6 | 0.8 | $Cr_3C_2$ 3 wt %<br>NbC 3 wt % | 6 | Extremely slight | Small | >30 | ○ | Present Examples |
| 50 | Residual | — | 20 | 6 | 0.8 | ZrB 1 wt %<br>$La_3O_3$ 18% | 19 | None | Small | >30 | ⊙ | Present Examples |
| 51 | Residual | — | 20 | 6 | 0.8 | ZrB 3 wt %<br>$CeO_2$ 12 wt % | 15 | None | Small | >30 | ⊙ | Present Examples |
| 52 | Residual | — | 20 | 6 | 0.8 | CrB 2 wt %<br>$Y_2O_3$ 8 wt %<br>$La_2O_3$ 8 wt % | 14 | None | Small | >30 | ⊙ | Present Examples |

Industrial Applicability

According to the present invention, especially in the processing of the high tensile strength steel, it is possible to provide an inside-furnace roll for a continuous annealing furnace having excellent build-up resistance and oxidization resistance properties. As a result, the operational loss which is associated with the maintenance or exchange of the rolls in the high tensile strength steel processing line can be eliminated, whereby the time during which the line is stopped can be shortened and the cost required for the maintenance of the rolls can be reduced.

What is claimed is:

1. A cermet powder for thermal spray coating, which is used for a conveyer roll inside a heat treating furnace for a steel strip, comprising:

an alloy powder containing 3 to 8 mass % of Al, 16 to 25 mass % of Cr, 0.1 to 1 mass % of Y, and at least one of Co and Ni as the residual, with respect to the whole amount of the cermet powder;

a ceramic powder containing at least one of 1 to 5 mass % of a boride and 5 to 10 mass % of a carbide, with respect to the whole amount of the cermet powder; and at least one type of rare earth oxide selected from the group consisting of $Y_2O_3$, $La_2O_3$ and $CeO_2$, by the total amounts of the compounds of not less than 10 mass % with respect to the whole amount of the cermet powder.

2. A cermet powder for thermal spray coating according to claim 1, wherein the cermet powder contains 1 to 25 mass % of the ceramic powder, with respect to the whole amount of the cermet powder.

3. A cermet powder for thermal spray coating according to claim 1, wherein the boride is present and contains at least one compound selected from the group consisting of $ZrB_2$, CrB, TiB, MoB, by the total content of the boride of 1 to 5 mass %.

4. A cermet powder for thermal spray coating according to claim 1, wherein the carbide is present and contains at least one compound selected from the group consisting of $Cr_3C_2$, TiC, NbC, TaC, by the total content of the carbide of 5 to 10 mass %.

5. A thermal spray coated roll, characterized in that it has a thermal sprayed coated film formed on a roll surface thereof, the coating being formed by spraying the cermet powder for thermal spray coating of any one of claim 1 or 2.

6. A thermal spray coated roll according to claim 5, wherein the thermal spray coated roll is a conveyer roll inside a heat treating furnace for a high tensile strength steel plate.

7. A cermet powder for thermal spray coating which is used for a conveyer roll inside a heat treating furnace for a steel strip, comprising:

an alloy powder containing 3 to 8 mass % of Al, 16 to 25 mass % of Cr, 0.1 to 1 mass % of Y, and at least one of Co and Ni as the residual, with respect to the whole amount of the cermet powder; and a ceramic powder containing 1 to 5 mass % of a boride, with respect to the whole amount of the cermet powder;

wherein the cermet powder contains powder of at least one type of rare earth oxide selected from the group consisting of $Y_2O_3$, $La_2O_3$ and $CeO_2$, by the total amounts of the compounds of not less than 10 mass % with respect to the whole amount of the cermet powder.

8. A cermet powder for thermal spray coating according to claim 7, wherein the cermet powder contains 1 to 25 mass % of the ceramic powder, with respect to the whole amount of the cermet powder.

9. A cermet powder for thermal spray coating according to claim 7, wherein the boride is present and contains at least one compound selected from the group consisting of $ZrB_2$, CrB, TiB, MoB, by the total content of the boride of 1 to 5 mass %.

10. A cermet powder for thermal spray coating which is used for a conveyer roll inside a heat treating furnace for a steel strip, comprising:

an alloy powder containing 3 to 8 mass % of Al, 16 to 25 mass % of Cr, 0.1 to 1 mass % of Y, and at least one of Co and Ni as the residual, with respect to the whole amount of the cermet powder; and a ceramic powder containing 1 to 5 mass % of a boride and 5 to 10 mass % of a carbide, with respect to the whole amount of the cermet powder;

wherein the cermet powder contains powder of at least one type of rare earth oxide selected from the group consisting of $Y_2O_3$, $La_2O_3$ and $CeO_2$, by the total amounts of the compounds of not less than 10 mass % with respect to the whole amount of the cermet powder.

11. A cermet powder for thermal spray coating according to claim 10, wherein the cermet powder contains 1 to 25 mass % of the ceramic powder, with respect to the whole amount of the cermet powder.

12. A cermet powder for thermal spray coating according to claim 10, wherein the boride is present and contains at least one compound selected from the group consisting of $ZrB_2$, CrB, TiB, MoB, by the total content of the boride of 1 to 5 mass %.

13. A cermet powder for thermal spray coating according to claim 10, wherein the carbide is present and contains at least one compound selected from the group consisting of $Cr_3C_2$, TiC, NbC, TaC, by the total content of the carbide of 5 to 10 mass %.

* * * * *